US007261280B2

(12) United States Patent
Takano et al.

(10) Patent No.: US 7,261,280 B2
(45) Date of Patent: Aug. 28, 2007

(54) ENGINE START DEVICE OF A ROTARY VALVE CARBURETOR

(75) Inventors: Jun Takano, Miyagi-Pref. (JP); Takashi Horikawa, Natori (JP)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 11/333,706

(22) Filed: Jan. 17, 2006

(65) Prior Publication Data

US 2006/0170120 A1 Aug. 3, 2006

(30) Foreign Application Priority Data

Feb. 2, 2005 (JP) ..... 2005-026219

(51) Int. Cl.
*F02M 9/08* (2006.01)

(52) U.S. Cl. ..... 261/44.6; 261/44.8

(58) Field of Classification Search ..... 261/44.6–44.8
See application file for complete search history.

(56) References Cited

U.S. PATENT DOCUMENTS

| | | | | |
|---|---|---|---|---|
| 5,942,160 | A * | 8/1999 | Araki | 261/44.8 |
| 6,142,455 | A * | 11/2000 | Araki | 261/44.8 |
| 6,231,033 | B1 * | 5/2001 | Araki | 261/44.8 |
| 6,769,670 | B2 * | 8/2004 | Ohgane et al. | 261/44.6 |
| 6,945,520 | B2 * | 9/2005 | Ohgane et al. | 261/44.6 |
| 6,983,928 | B2 * | 1/2006 | Araki | 261/34.2 |
| 2003/0111743 | A1 * | 6/2003 | Ohgane et al. | 261/44.8 |
| 2004/0130040 | A1 * | 7/2004 | Araki | 261/34.2 |
| 2005/0017379 | A1 * | 1/2005 | Ohgane et al. | 261/44.6 |

FOREIGN PATENT DOCUMENTS

| | | | | |
|---|---|---|---|---|
| JP | 1-294947 | A * | 11/1989 | 261/44.8 |

* cited by examiner

*Primary Examiner*—Richard L. Chiesa
(74) *Attorney, Agent, or Firm*—Reising, Ethington, Barnes, Kisselle, P.C.

(57) ABSTRACT

A compact engine start device of a combustion engine rotary-type carburetor overrides normal operation of a rotary throttle valve to provide a richer mixture of fuel-and-air to start a cold engine. Rotation of a start lever of the start device activates a releasable camming interface coupler causing the throttle lever to rotate about a rotary axis and axially lift partially out of the carburetor at prescribed angular and axial distances. This provides the engine, through a fuel-and-air mixing passage, with a controlled and enriched ratio and volume of a fuel-and-air mixture. Preferably, the start lever has a projecting rod that inserts into a hole in the carburetor body for rotation about an axis orientated substantially parallel to the rotary axis. An outward surface of the start lever is in rotational sliding contact with a low-profile, preferably cantilevered, retention arm preferably formed unitarily to a metering fuel pump cover engaged removably to the body of the carburetor, thus allowing rotational movement but preventing axial movement of the start lever. Because the start lever does not move axially to displace the rotary throttle valve, the height of the start lever is favorably minimized. Moreover, the start lever preferably has a knob for user interface at a distal end of the lever that conforms generally about the retention arm thus maximizing knob size yet not contributing to an increase in carburetor size.

22 Claims, 8 Drawing Sheets

ENGINE START DEVICE OF A ROTARY VALVE CARBURETOR

RELATED APPLICATIONS

Applicants claim priority of Japanese Application No. 2005-026219, filed Feb. 2, 2005.

FIELD OF THE INVENTION

The present invention relates to a rotary valve carburetor for a combustion engine and more particularly to an engine start device of the carburetor.

BACKGROUND OF THE INVENTION

Known rotary-type carburetors have a fuel-and-air mixing passage orientated through a body for flowing a controlled ratio and volume of a fuel-and-air mixture to a combustion engine. This control is generally provided by a throttle valve rotatably and axially movable in a cylindrical cavity transverse to the mixing passage. A cylindrical portion of the throttle valve located in the cavity carries a through-bore that when rotated generally aligns adjustably to the mixing passage generally controlling the mixture flow rate. The cylindrical portion also supports a needle orientated concentrically to a rotary axis of the throttle valve and projecting into the through-bore for receipt into an open end of an axially confronting fuel feed tube supported by the carburetor body. A cylindrical wall of the feed tube carries an orifice opening into the through-bore for the flow of liquid fuel into the mixing passage and from a fuel metering chamber communicating with the feed tube. Axial movement of the rotary throttle valve shifts the needle axially with respect to the feed tube thus adjustably obstructing the orifice thereby controlling fuel flow into the through-bore and mixing passage.

Generally, a cammed interface between the cylindrical portion of the throttle valve and the carburetor body acts to move the throttle valve axially in response to rotational movement of the same. Rotational movement is achieved through operator intervention generally placed upon a throttle lever disposed outside of the carburetor body and typically engaged to the cylindrical portion via a rotatable valve shaft.

Such rotary-type carburetors are known to have engine start devices that act to supply an enriched fuel-and-air mixture to a cold engine for starting. These start devices typically carry cam surfaces required to cause axial movement of the throttle valve. Unfortunately, known start devices have numerous parts and the known cam surfaces require structure that projects further outward from the carburetor body than does the throttle lever at its furthest axial withdrawn (wide open) state thus considerably enlarging the carburetor size. Moreover, known start levers having a handle or knob at a distal end for leverage that must also project a considerable distance from the carburetor body hindering a desirable compact carburetor design.

SUMMARY OF THE INVENTION

A compact engine start device of a combustion engine carburetor interfaces with a rotary throttle valve of the carburetor that operatively intersects a mixing passage extending through a body of the carburetor. Preferably, a camming mechanism is carried between the rotary throttle valve and the body for axially moving the valve along a rotary axis to generally adjust the quantity of fuel flow into the mixing passage as the valve rotates about the rotary axis for generally adjusting the quantity of air flow through the mixing passage, thereby establishing a generally consistent fuel to air ratio. The start device preferably operates to disengage the camming mechanism and provide a richer mixture of fuel and air for starting the engine.

Rotation of a start lever of the start device causes the start lever to circumferentially contact an abutment of a throttle lever of the throttle valve while axially engaging a releasable camming interface coupler carried between the throttle lever and the start lever for moving the throttle lever axially as it is rotated about a rotary axis by the start lever. The camming interface coupler causes the throttle lever to axially lift partially out of the carburetor at prescribed angular and axial distances while disengaging the camming mechanism utilized by the rotary throttle valve during normal operation of the engine. The prescribed angular and axial positions of the throttle lever as generally established by the camming interface coupler when the start lever is in contact with the throttle lever increases the enrichment of a fuel and air mixture flowing through the mixing passage for engine cold starting relative to when the camming mechanism is engaged during normal operation.

Preferably, the start lever has a projecting rod that inserts into a hole in the carburetor body for rotation about an axis orientated substantially parallel to and spaced radially outward from the rotary axis. An outward surface of the start lever is in rotational sliding contact with a low-profile, preferably cantilevered, retention arm preferably formed unitarily to a metering fuel pump cover of the body of the carburetor, thus allowing rotational movement while preventing axial movement of the start lever. Because the start lever does not move axially to axially displace the rotary throttle valve, the height of the start lever is favorably minimized. Moreover, the start lever preferably has a leveraging knob for user interface at a distal end of the lever that conforms generally about the retention arm for maximizing its size while not contributing to an increase in overall carburetor size.

The releasable camming interface coupler preferably has a step-sloped camming surface carried by the start lever that is slidably in contact with an arcuate rib carried by the throttle lever. Preferably, the arcuate rib projects toward a carburetor body and lies generally within an imaginary plane orientated perpendicular to the rotary axis. Rotation of the start lever from a rest position causes the camming surface to generally move between the body and the throttle lever thereby engaging the arcuate rib and urging it in a substantially axial direction while the start lever circumferentially contacts an abutment on the throttle lever. With continued rotation of the start lever, this contact causes the throttle lever to rotate in a counter rotational direction and the sloped camming surface to axially lift the throttle lever. When the releasable camming interface coupler is so engaged the conventional cam mechanism of the rotary carburetor disengages between the body and the rotary throttle valve.

Objects, features and advantages of this invention include a compact design of a rotary valve carburetor having an engine start device that automatically disengages during normal engine operation, improves cold engine starts, enhances operator confidence via the felt indenting of the camming interface coupler, improved leveraging for engaging the engine start device, fewer parts, relatively simple design, inexpensive to manufacture and assemble, robust, easily adjustable and maintained, reliable, durable and in service has a long useful life.

BRIEF DESCRIPTION OF THE DRAWINGS

These and other objects, features and advantages of this invention will be apparent from the following detailed description, appended claims and accompanying drawings in which:

DETAILED DESCRIPTION OF THE PREFERRED EMBODIMENTS

Figure 1:
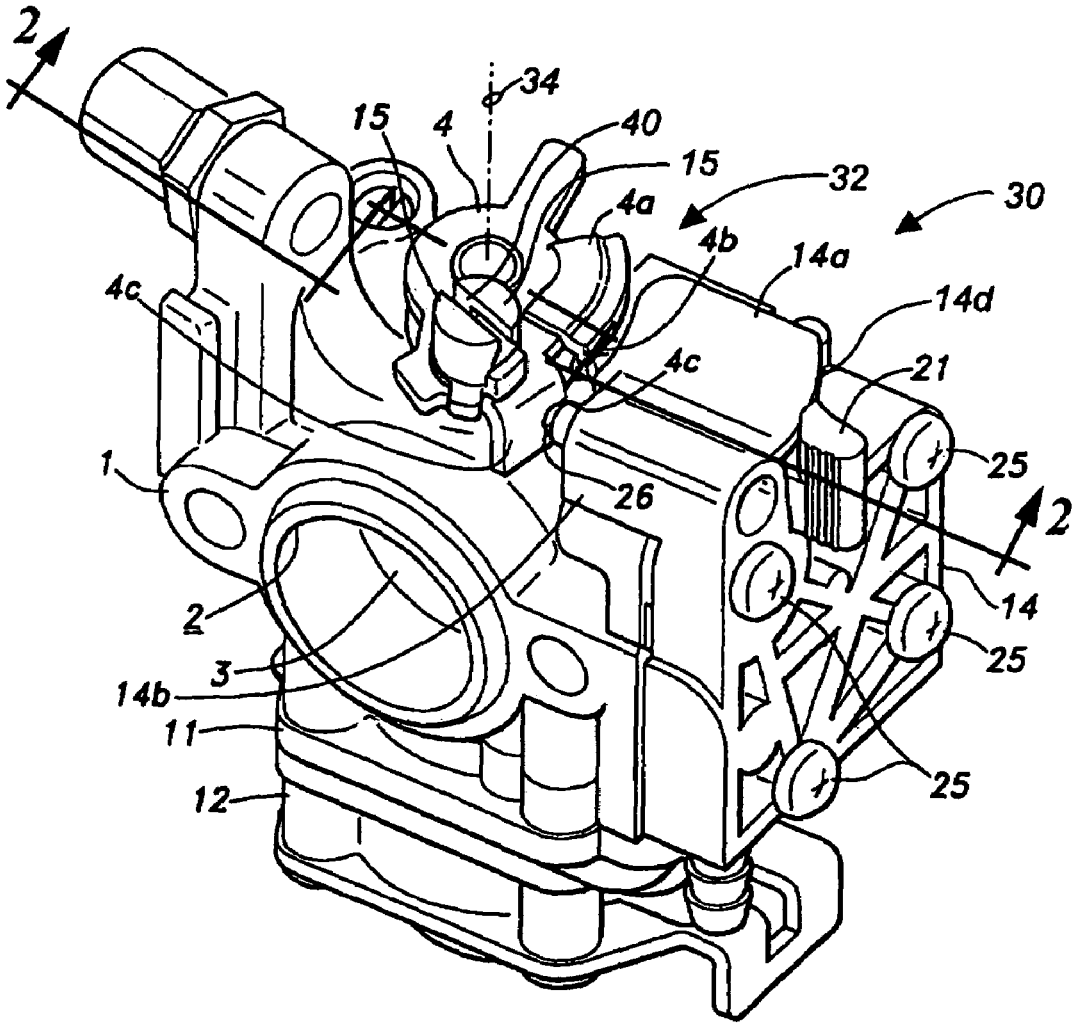
FIG. 1 is a perspective view of a rotary-type carburetor having an engine start device embodying the present invention.
Figure 2:
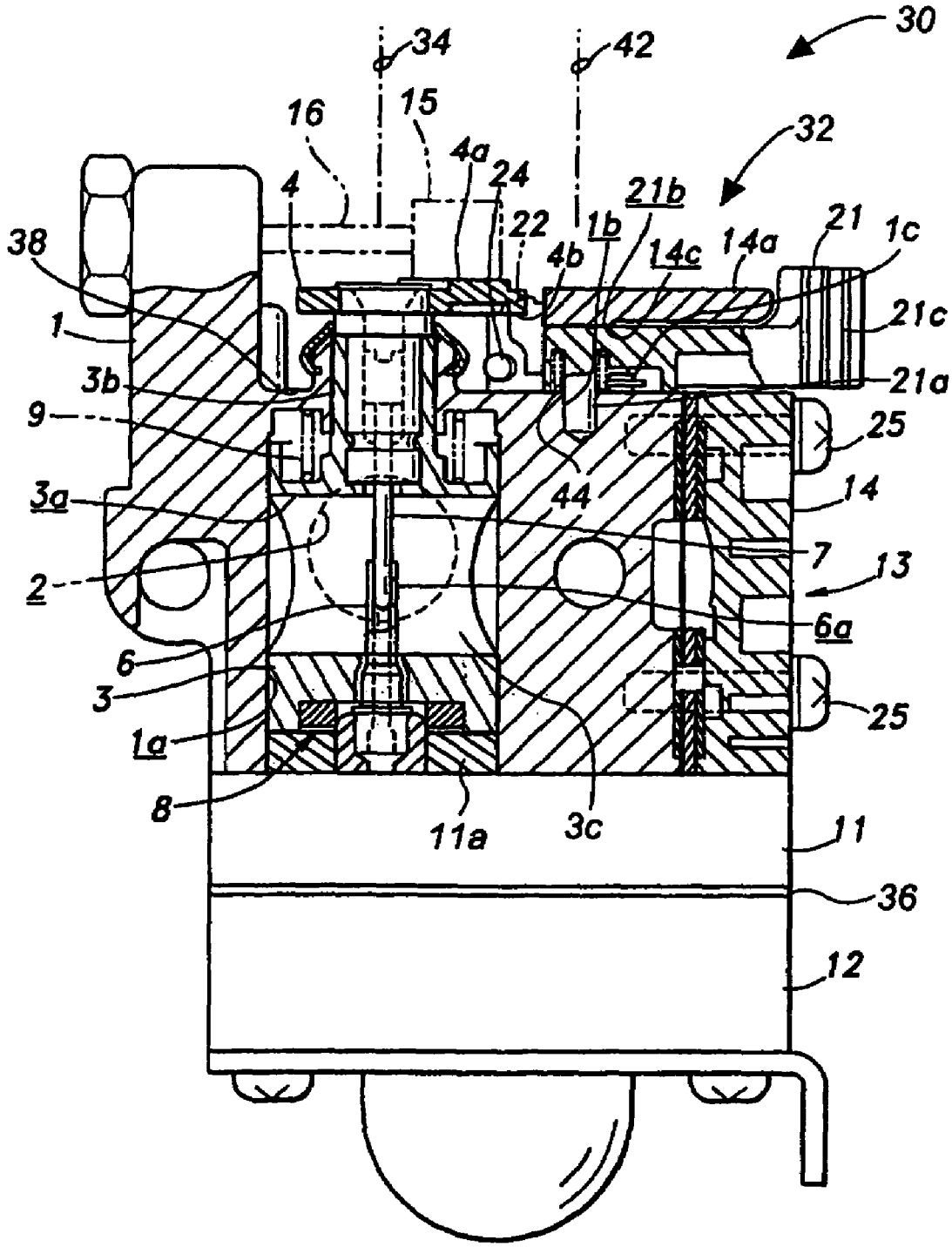
FIG. 2 is a fragmentary cross section of the rotary-type carburetor taken along broken line 2-2 of FIG. 1.

As best illustrated in FIGS. 1 and 2, a rotary valve carburetor 30 embodying a start engine device 32 of the present invention has a fuel-and-air mixing passage 2 extending through a main body 1. A substantially cylindrical cavity 1*a* carried by the body 1 extends transversely across the mixing passage 2 for generally rotatable and axially movable receipt of a rotary throttle valve 3. The rotary throttle valve 3 has a cylindrical portion 3*c* that rotates about and moves axially with respect to a rotary axis 34 disposed substantially perpendicular to the mixing passage 2, and a through-bore 3*a* orientated generally perpendicular to the rotary axis 34 and extending transversely through the cylindrical portion 3*c*. The through-bore 3*a* is orientated so that the degree or extent of communication with the fuel-and-air mixing passage 2 varies between a fully closed state and a fully open state. Preferably, the lower part of the carburetor main body 1 has a first segment or mid plate 11 defining in part a fuel metering chamber (not shown) and an interfacing lower segment or plate 12 defining in part a reference chamber usually at near atmospheric pressure. A resilient diaphragm 36 sealed preferably along a peripheral edge between the plates 11, 12 defines in-part the fuel chamber on one side and the reference chamber on an opposite dry side.

The fuel metering chamber receives liquid fuel from a fuel pump 13 preferably orientated on one side of the carburetor 30. The fuel pump 13 has a fuel chamber defined by a face carried by the carburetor main body 1, a pulsating pressure chamber defined in-part by a pump cover 14 of the body 1 generally attached to the face of the carburetor main body 1, and a reed or check valve (not shown) preferably formed by a flexible membrane or the like interposed between the face of the carburetor main body 1 and the pump cover 14 of the body 1. The pulsating pressure chamber on the side of the pump cover 14 preferably communicates with the crankcase chamber of the internal combustion engine so that the pulsating pressure of the crankcase chamber provides a pumping action for producing a prescribed fuel supply to the fuel metering chamber in the fuel metering chamber plate 11.

A stationary fuel nozzle or fuel feed tube 6 supplies fuel to the mixing passage 2 from the fuel metering chamber which is at a substantially constant pressure as provided by operation of the metering diaphragm 36. The fuel nozzle 6 projects into the through-bore 3*a* and slidably receives the axially opposed fuel metering needle 7 of the throttle valve 3 which is carried by the cylindrical portion 3*c* and extends along the rotary axis 34 to project into the through-bore 3*a*. The tip of the fuel metering needle 7 is received in the fuel nozzle 6 for control of liquid fuel flow. The cylindrical wall of the fuel nozzle 6 is provided with an orifice or fuel jet 6*a* at a point corresponding to the tip of the fuel metering needle 7 along the axial direction.

The rotary throttle valve 3 preferably has a valve shaft 3*b* projecting co-axially upward from the cylindrical portion 3*c*, extending out of the carburetor main body 1, and attached to a radially projecting throttle lever 4. The cross sectional flow area of the fuel-and-air mixing passage 2 is controlled by the angular position of the rotary throttle valve 3. Simultaneously, the cross sectional flow area of the orifice 6*a* is varied by axial displacement of the fuel metering needle 7 to control the amount of liquid fuel flowing into the through-bore 3*a*. The cross sectional flow area of the orifice 6*a* corresponds to the change in the cross sectional flow area of the fuel-and-air mixing passage 2 during normal operation of the engine.

The lower opening of the valve cavity 1*a* is preferably closed by a plug member 11*a* of the fuel metering chamber plate 11 of the body 1. A disengagable cam mechanism 8, orientated axially between the plug member 11*a* and the lower surface of the rotary throttle valve 3, axially moves the rotary throttle valve 3 in dependence on the angular position thereof. The disengagable cam mechanism 8 preferably has a cam surface (not shown) having a slope formed on the lower surface of the rotary throttle valve 3 and a cam follower member provided on the plug member 11*a* of the body 1 that slides over the cam surface. At the upper opening of the valve cavity 1*a* is an annular shoulder 38 of the body 1 projecting radially inward and disposed axially over the cylindrical portion 3*c* of the rotary throttle valve 3. Generally interposed axially between the annular shoulder 38 and the cylindrical portion 3*c* of the rotary throttle valve 3 is a coiled compression spring 9 that not only resiliently, and axially urges the cam surface of the rotary throttle valve 3 against the cam follower member on the top side of the plug member 11*a* but also serves as a torsion spring to resiliently urge the cylindrical portion 3*c* of the rotary throttle valve 3 toward its fully closed position.

Preferably, an operator remotely rotates the throttle lever 4 using a Bowden or control cable 16 that connects to a coupler 15 projecting upward from and engaged rotationally to the throttle lever 4 at a radial distance from the rotary axis 34 for leverage. The coupler 15 is preferably substantially cylindrical in shape and has a diametrically extending slit 40 opening upward for receipt of an enlarged end of the cable 16.

Figure 3:
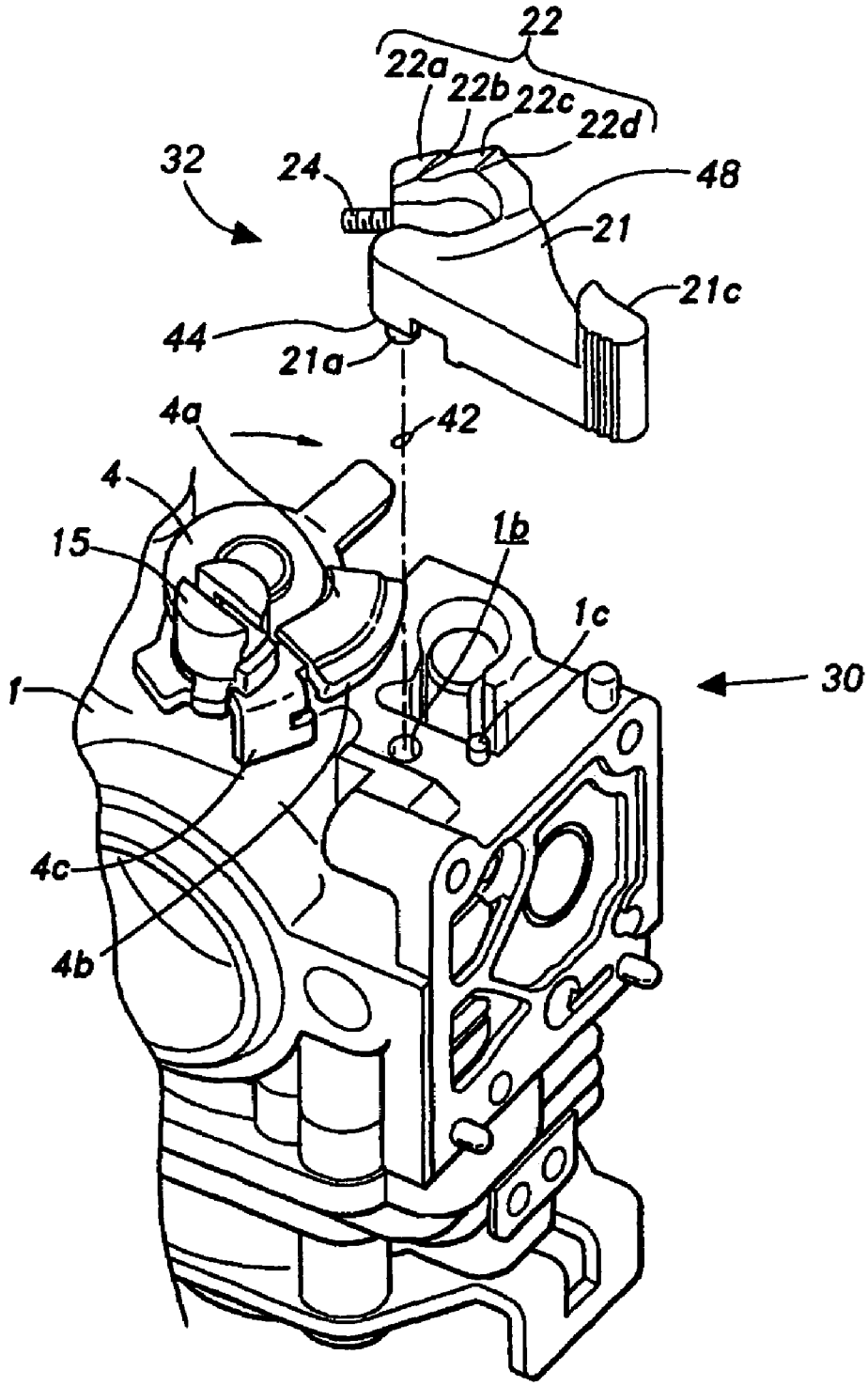
FIG. 3 is an exploded partial perspective view of the rotary-type carburetor.

The engine start device 32 of the carburetor 30 generally includes a rotatable start lever 21 mounted rotatably on the carburetor body 1 about an axis 42 spaced radially outward from and disposed substantially parallel to the rotary axis 34 of the throttle lever 4. A short rod 21*a* of the start lever 21 is disposed concentrically to the axis 42 and preferably projects unitarily downward from an inward surface 44 of the start lever 21 (as best shown in FIGS. 2 and 3). Preferably, the rod 21*a* is snugly and rotatably received in a hole or bore 1*b* carried by the body 1. Rotation of the start lever 21 about the axis engages a cam interface coupler 33 carried between the start lever 21 and the throttle lever 4 for generally disengaging the camming mechanism 8 and moving the throttle valve axially to enrich the fuel and air mixture generally for cold engine starts.

The start lever 21 carries a cam 22 of the cam interface coupler 33 that can be selectively orientated and engaged with the throttle lever 4 to position the throttle valve for cold starting of the engine. Rotating the start lever 21 about the axis 42 engages the cam 22 with the throttle lever 4, thus generally disengaging the camming mechanism 8 by axially lifting the cylinder portion 3*c* of the throttle valve 3 away from the plug member 11*a* and against the biasing force of the yieldable compression spring 9. The start lever 21 thus interacts with the throttle lever 4 for rotating the rotary throttle valve 3 to a prescribed angular position and, at the same time, axially moving the throttle valve by a prescribed axial distance which disengages the camming mechanism 8 when cold starting the engine. This prescribed throttle valve position increases the supply of liquid fuel thus increasing the enrichment of the fuel-and-air mixture required for cold starting the engine.

Figure 5:
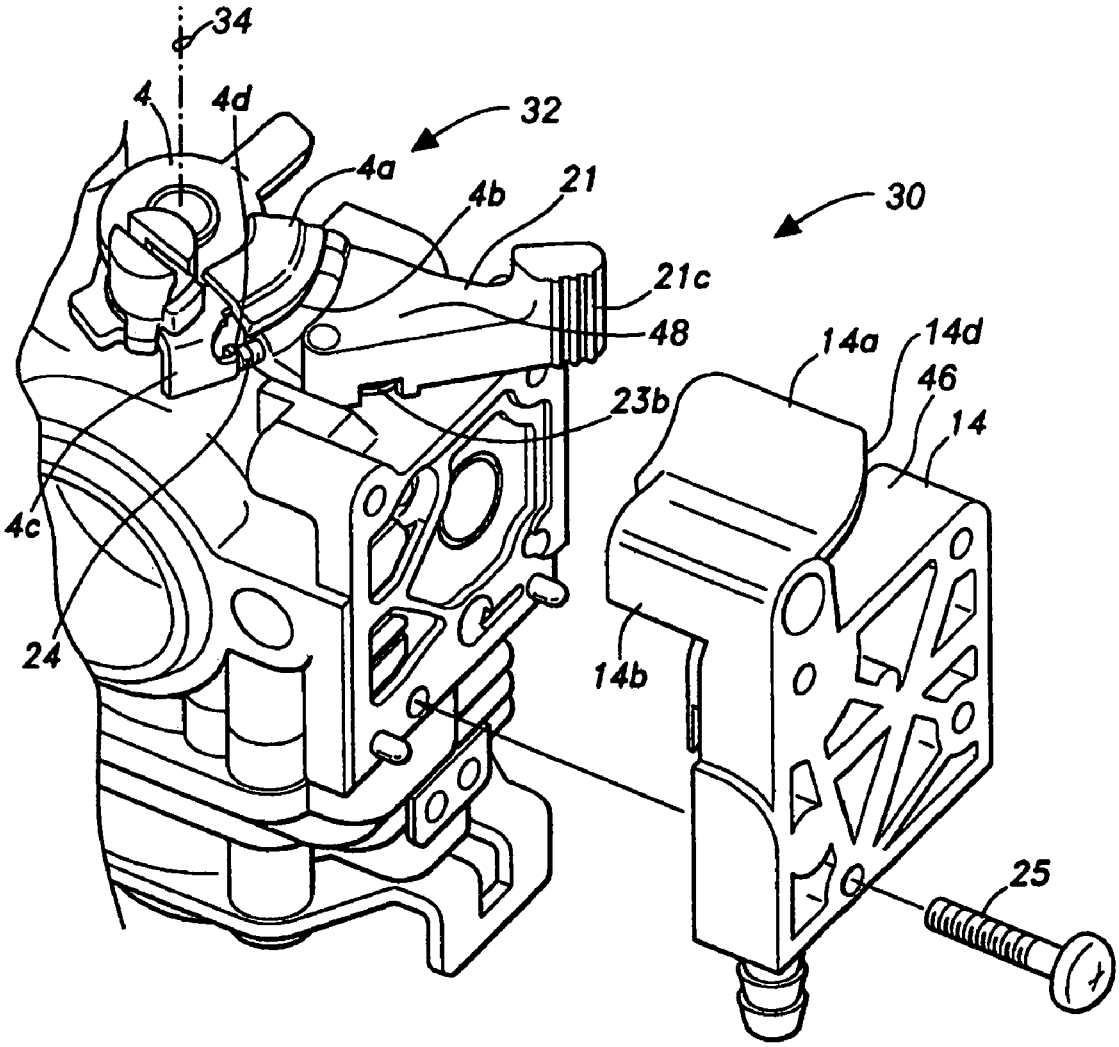
FIG. 5 is an exploded perspective view showing how a pump cover is assembled.

As best illustrated in FIGS. 2 & 5, the start lever 21 is retained axially in the bore 1*b* by a generally wide and substantially planar retention arm 14*a* cantilevered over the start lever and projecting at a substantially right angle and unitarily from a base support member 14*b* that preferably projects outward from the pump cover 14. The cantilevered retention arm 14*a* projects outward from the base support member 14*b* so as to overhang the start lever 21 and generally form a clearance 46 between a distal or suspended end 14*d* of the arm 14*a* for a portion of the start lever 21 to rotate out of when moving from the rest position and toward the engaged position. A substantially friction-free sliding surface 14*c* carried by the retention arm 14*a* is in sliding engagement with an axially opposing outward surface 48 of start lever 21.

The start lever 21 is elongated and extends radially with respect to axis 42. A first end of the start lever 21 projects generally toward the throttle lever 4 and carries the cam 22 and a substantially diametrically opposite second end of the start lever 21 projects radially outward to form a corrugated thumb hold or knob 21*c* for the operator to grasp with a finger or thumb without slippage. The throttle lever 4 has a fan-shaped portion 4*a* extending axially outward and carrying a circumferentially extending, arcuate, and downward projecting cam engagement portion or rib 4*b* of the camming interface coupler 33 that generally confronts the cam 22 for moving the throttle lever 4 axially outward. Preferably, the start lever 21 and the cam 22 are preferably unitary and manufactured as a single part. The throttle lever 4 including the rib 4*b* is preferably stamped during manufacturing from a single metallic plate.

As best illustrated in FIGS. 1, 3 and 5, the start lever 21 is provided with a threaded adjuster or screw 24 for adjustment of the angular position of the lever 21 relative to the throttle lever 4 at the time of contact. The metallic throttle lever 4 is formed or stamped with a bent planar tab 4*c* projecting from a peripheral part of the throttle lever 4 and toward the carburetor body 1 and substantially lying in an imaginary plane disposed parallel to the rotary axis 34 of the valve shaft 3*b*. An abutment or abutment tab 4*d* projects radially inward from a rotationally trailing edge of the bent tab 4*c* and lies within an imaginary plane orientated substantially perpendicular to the bent tab 4*c*. As the start lever 21 is turned from the initial or rest position, the free end of the adjustment screw 24 eventually contacts the abutment tab 4*d* provided the throttle lever 4 is in the closed position, and further rotation of the start lever 21 causes the throttle lever 4 to rotate in a counter direction toward the open position. The width (i.e. radial projection) of the abutment tab 4*d* is determined in such a manner that the adjustment screw 24, although sliding thereon, continues to bear on the abutment tab 4*d* while the throttle lever 4 is turned to an angular position or mode suitable for starting the engine.

Figure 6A:
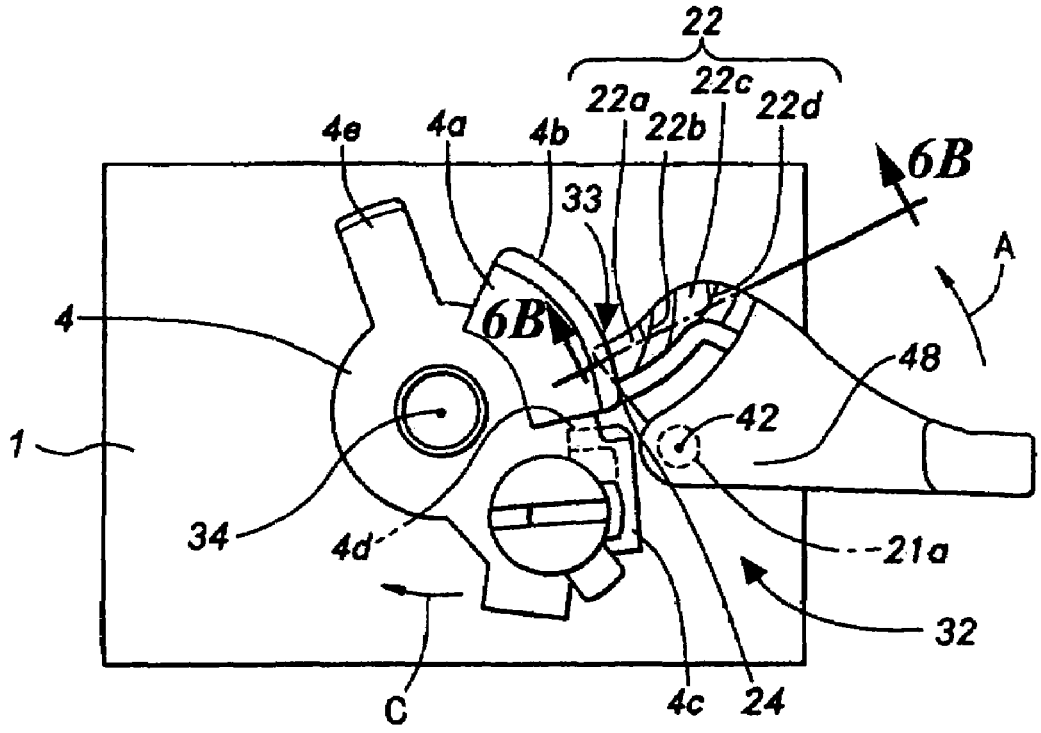
FIG. 6A is plan view showing the start lever in a rest position.
Figure 6B:
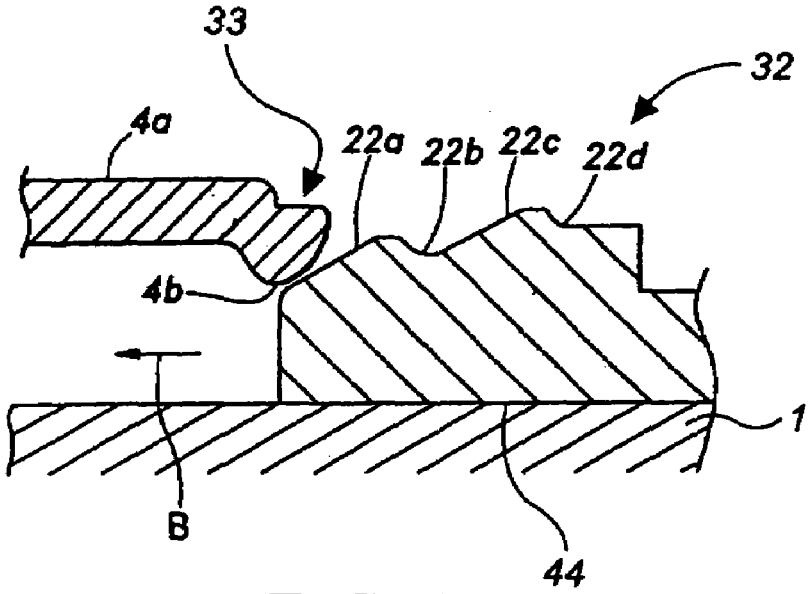
FIG. 6B is an enlarged fragmentary section view showing a cam interface coupler of the engine start device in the rest or disengaged position and taken along line 6B-6B of FIG. 6A.

In operation, the arcuate rib 4*b* of the fan-shaped portion 4*a* of the throttle lever 4 initially engages the cam 22 when the throttle lever 4 is in the fully closed position and the start lever 21 is initially being turned toward an engine start position or mode. To automatically avoid this camming engagement when the engine is operating in a normal condition other than a starting condition, the start lever 21 is fitted with a return, torsional, coil spring 23 engaged at opposite ends between the start lever 21 and the body 1 so that the start lever 21 is urged or biased to the rest position under the spring force of the return spring 23. As best shown in FIGS. 6A and 6B, when the start lever 21 is in the rest position the cam 22 of the start lever 21 and fan-shaped portion 4*b* of the throttle lever 4 are mutually out of engagement or de-coupled. Therefore, the rotary throttle valve 3 is in the fully closed position and the disengagable cam mechanism 8 of the rotary throttle valve 3 is functional and engaged.

Referring to FIGS. 6A-6B, the cam 22 of the start lever 21 is provided with a stepped shape including two levels so that the throttle valve rotational opening angle and fuel supply at the time of cold starting the engine may be varied depending on the particular situation. It may also have three or more levels. The cam 22 is formed with a leading first slope or cam surface 22*a*, a first indent or groove 22*b*, then a second slope or cam surface 22*c* and a trailing second recess or groove 22*d*. The bottom surface of the first groove 22*b* is higher than the lower rib 4*b* of the fan-shaped portion 4*a* when the throttle valve 3 is in the fully closed position (with the camming mechanism 8 engaged) by a prescribed distance, and the bottom surface of the trailing second groove 22*d* is higher than the bottom surface of the first engagement portion 22*b* by a prescribed distance. The first and second grooves 22*b* and 22*d* lie within respective imaginary planes disposed substantially perpendicular to the rotary axis 34.

When the downward rib 4*b* rides over the first slope or cam surface 22*a* and falls into the first groove 22*b*, there is a detent action felt by the operator. Similarly, when the downward rib 4*b* rides over the second slope or cam surface 22*c* and falls into the second groove 22*d*, there is also a detent action felt by the operator. Thereby, the operator can easily place the start lever 21 in the positions for the first starting mode and second starting mode without any difficulty. The engagement surfaces of the two grooves 22*b* and 22*d* are generally arcuate and oriented in such a manner that they enable a prolonged contact interface with the downward projecting and elongated rib 4*b* depending on the angular position of the start lever 21 so that a state of secure and continued engagement can be achieved.

When cold starting the engine, an operator first grasps the corrugated knob 21*c* of the start lever 21 and thereby partially rotates the start lever 21 as indicated by arrow A in FIG. 6A. This rotational movement causes the cam 22, carried by the generally opposite front end of the start lever 21, to slide in the direction indicated by arrow B in FIG. 6B. When the start lever 21 is turned further from the position illustrated in FIG. 6A, the rib 4*b* of the throttle lever 4 slides over the leading first slope or cam surface 22*a*, thus axially lifting of the throttle valve 3 while the adjustment screw 24 of the start lever 21 engages the abutment tab 4*d* of the throttle lever 4. With continued rotation of the start lever 21, the adjustment screw 24 pushes the abutment tab 4*d* as the distal end face of the adjustment screw 24 generally slides (in a radially outward direction) over the surface of the abutment tab 4*d* with the result that the throttle lever 4 turns in the opening direction indicated by arrow C in FIG. 6A in synchronism with the rotation of the start lever 21.

Figure 7A:
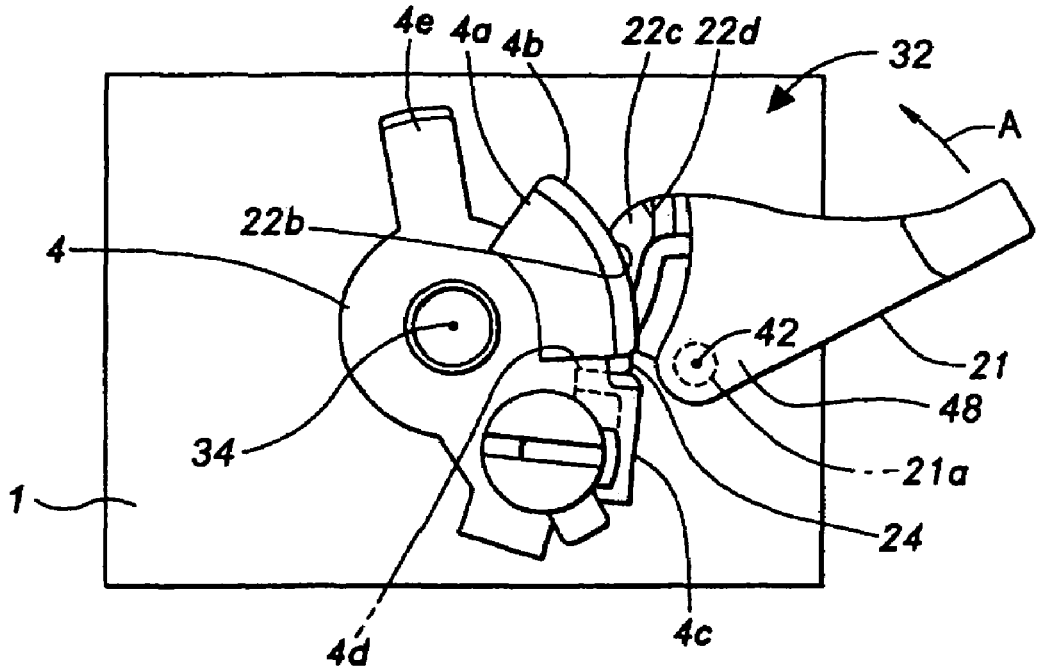
FIG. 7A is a view similar to FIG. 6A in a first starting mode.
Figure 7B:
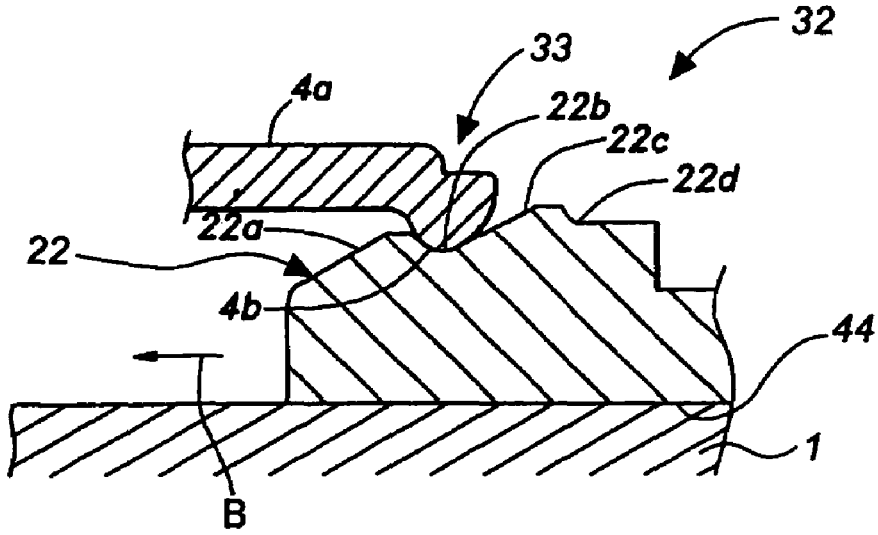
FIG. 7B is a view similar to FIG. 6B in the first starting mode.

When the start lever 21 is turned by a certain angle and has reached the position indicated in FIGS. 7A and 7B, the first slope or cam surface 22*a* has moved past the arcuate rib 4*b* and engages the first engagement portion 22*b*. This is the first starting mode reflecting a relatively small valve opening angle and a small fuel supply that is a desirable start position when the engine temperature is not significantly cold. Because the camming mechanism 8 of the rotary throttle valve 3 is preferably disengaged automatically by rotation of the start lever 21 (i.e. the cylinder portion 3*c* is lifted axially more than the axial lift created by mere rotation upon the camming mechanism), the fuel-and-air mixture produced with this orientation is richer than normal operation of the throttle valve when the camming mechanism is engaged.

Figure 8A:
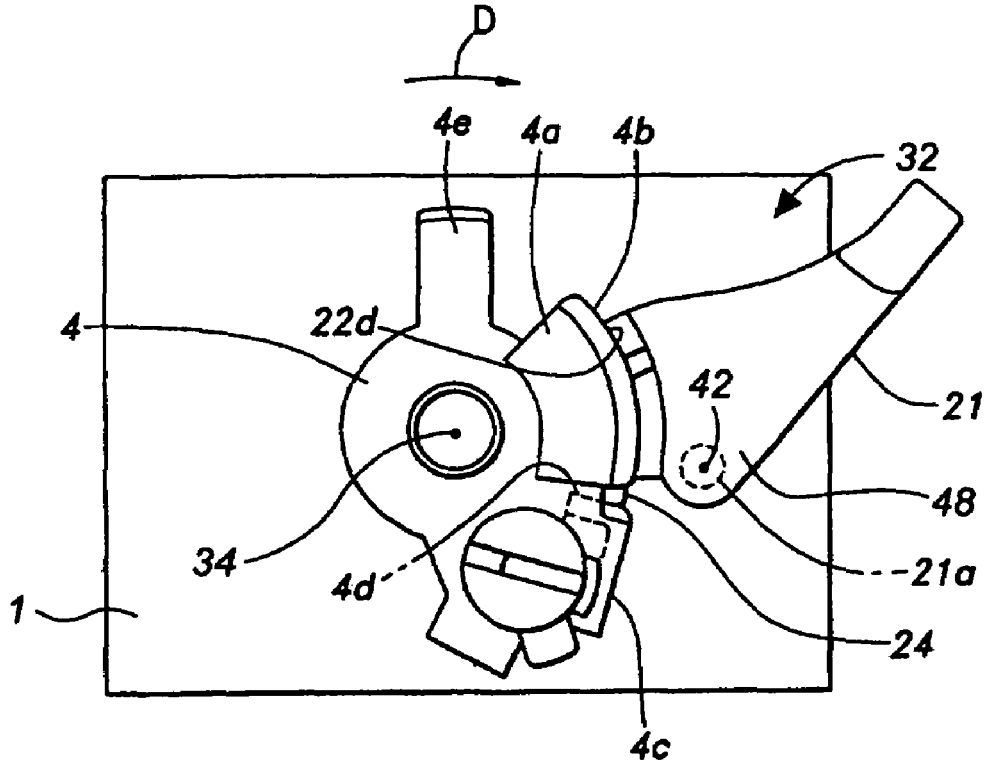
FIG. 8A is a view similar to FIG. 6A in a second starting mode.
Figure 8B:
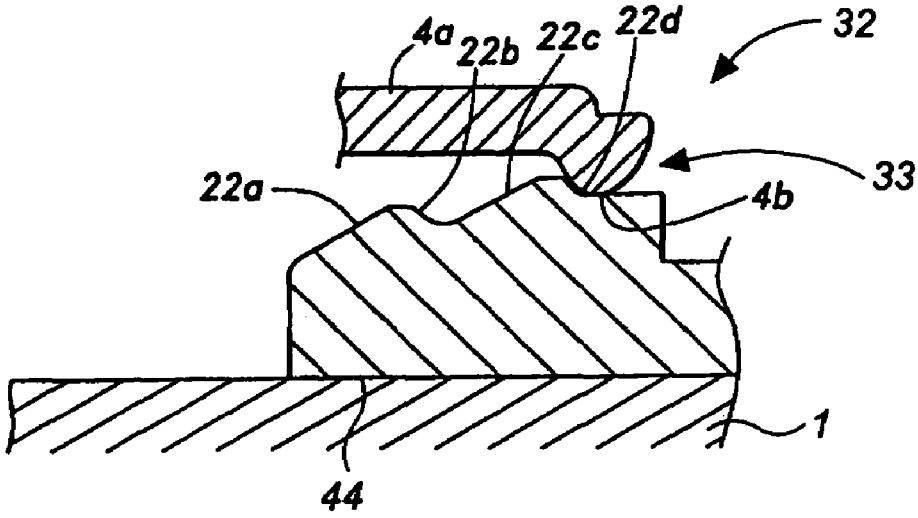
FIG. 8B is a view similar to FIG. 6B in the second starting mode.

When the start lever 21 is turned further and has reached the position indicated in FIGS. 8A and 8*b*, it rides over the second slope or cam surface 22*c* and moves past the arcuate rib 4*b*, and the rib 4*b* engages or generally snaps into the trailing second groove 22*d*. This creates a second starting mode reflecting a valve opening angle and a fuel supply that are greater than those of the first starting mode. When the engine temperature is significantly cold and an increased difficulty is expected in starting the engine, the richer mixture of the second starting mode is desirable.

Once the engine starts, the starting mode of the engine start device 32 may be terminated by utilizing the control cable 16 to further open the throttle valve 3. During this rotation of the throttle valve 3, the cylindrical portion 3*c* of the rotary throttle valve 3 does not substantially axially move, however, the camming mechanism 8 does move toward re-engagement. With continued rotation of the throttle valve 3, the circumferentially extending rib 4*b*, and the engagement between rib 4*b* and the groove 21*b* or 21*d* of the start lever 21 is released with the result that the start lever 21 returns to the rest position under the action of the return spring 23, and the camming mechanism 8 re-engages either smoothly or by a slight axial fall of the throttle lever 4 and cylinder portion 3*c*.

The initial rotation of the throttle lever 4 without axial movement of the throttle valve 3 increases the cross section flow area of the through-bore 3*a*. This increases air flow without generally increasing liquid fuel flow thus leaning-out the rich mixture of fuel and air after the engine starts. Moreover, any slight axial fall of the throttle valve 3 when the throttle lever releases from the start lever also has the affect of leaning out the rich mixture of fuel and air otherwise needed for cold starting of the engine. Thus, without taking any special action, the cold starting mode can be readily terminated simply by opening the throttle valve 3 in a normal way, and it is possible to move on from the starting mode to the leaner normal operation mode in a smooth fashion.

When the control cable 16 is not attached to the coupler 15, it is possible to turn the throttle lever 4 in the valve opening direction by directly operating an engagement releasing handle 4*e* of the throttle lever 4. This allows the throttle valve 4 to be opened when testing the carburetor 30 on the manufacturing assembly line. Also, the control cable 16 can be easily connected to the coupler 15 during the assembly process by turning the throttle lever 4 in such a direction as to bring the coupler 15 closer to the control cable 16. Because the downward rib 4*b* extends circumferentially at a constant radius, the engagement with grooves 22*b* or 22*d* can be maintained even while the throttle lever 4 is turned in the start mode and with the camming mechanism 8 disengaged. In other words, the valve opening angle can be freely changed within a limited range while keeping the supply of fuel at a fixed level, and this range can be shifted by turning the adjustment screw 24 allowing fine adjustment of the starting mode.

During the manufacturing process, the cylindrical valve cavity 1*a* is preferably open at the lower end to permit axial insertion of the cylindrical portion 3*c* and shaft 3*b* of the rotary throttle valve 3. The annular shoulder 38 of the body 1 is located at the opposite upper end of the cavity 1*a* and defines a concentrically located circular hole through which the valve shaft 3*b* passes.

Figure 4A:
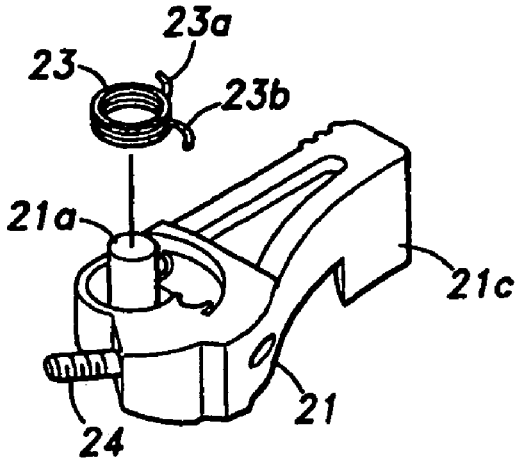
FIGS. 4A to 4C are perspective views showing a process of assembling a return spring to a start lever of the engine start device.
Figure 4B:
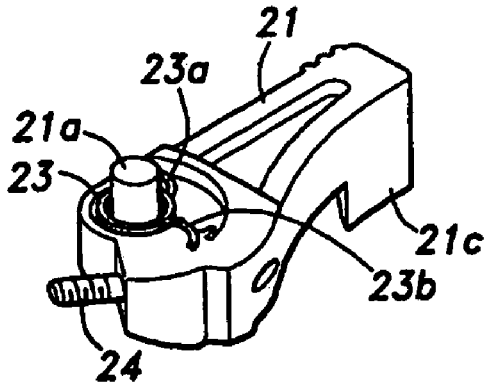
Figure 4C:
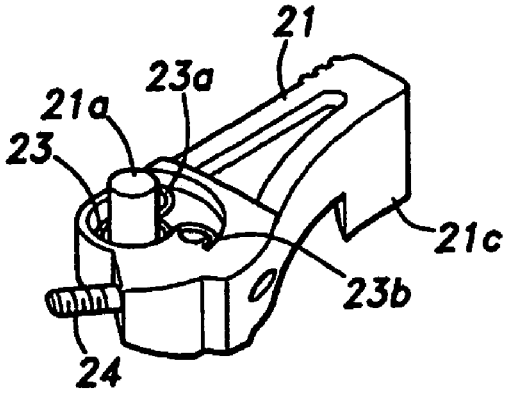

As best illustrated in FIGS. 2 and 4A-4C and during manufacture of the carburetor 30, the coiled return spring 23 is slipped axially over the short rod 21*a* of the start lever 21. A first coil end 23*a* of the return spring 23 is fit into an engagement groove formed in the lower surface of the start lever 21 (facing the carburetor body 1 when fully assembled) as shown in FIG. 4B. The fit of the first end circumferentially aligns an opposite coil end 23*b* of the return spring 23 with respect to the axis 42 and axially places the end 23*b* adjacent to the lower surface of the start lever 21 as shown in FIG. 4C, thus staging the start lever 21 and spring 23 for mounting on the carburetor body 1.

The coil end 23*b* is shaped like a hook and is pre-staged or positioned to form in-part a circular opening also defined in-part by the start lever 21, as best shown in FIG. 4C. The carburetor main body 1 is formed with a projecting engagement stud 1*c* dimensioned to be received in this circular opening (see FIGS. 2 and 3). The start lever 21 having the return spring 23 provisionally mounted thereon is mounted on the carburetor main body 1 with the short rod 21*a* fitted into the hole 1*b* and the engagement stud 1*c* fitted into the circular opening defined jointly by the other end 23*b* and the corresponding part of the start lever 21 when assembled.

As best illustrated in FIG. 3, during assembly the throttle lever 4 is rotated toward the fully open position thus placing the fan-shaped portion 4*a* of the throttle lever 4 circumferentially clear of the adjustment screw 24 when mounting the start lever 21 on the carburetor main body 1 from above. When assembling the staged start lever 21, the short rod 21*a* is fitted into the hole 1*b* before the pump cover 14 is mounted, thus preventing interference by the cantilevered retention arm 14*a*. When the pump cover 14 is mounted on the side of the carburetor main body 1 from a perpendicular direction with respect to the rotary axis 34, the start lever 21 is rotated to a maximum angular position away from the rest position or to the second start mode so that the cantilevered retention arm 14*a*, formed unitarily as one piece with the pump cover 14, does not interfere with the knob 21*c* of the start lever 21. Preferably, the pump cover 14 of body 1 secured and sealed to the remaining portion of carburetor body 1 by a plurality of fasteners or threaded bolts 25.

By adopting this assembling process, it is possible to maximize or increase the size of knob 21*c* for improved interaction with a finger or thumb of an operator and reduce the height of the start lever 21 (the projection from the upper surface of the carburetor main body 1) so that the projection of the components (including the retention arm 14*a*) of the carburetor 30 where the start lever 21 is provided can be minimized.

As best illustrated in FIG. 1, preferably the cantilevered retention arm 14*a* of the pump cover 14 has an idle adjustment screw 26 that is threadably movable along the length of the cantilevered retention arm 14*a*. By abutting the front end of the idle adjustment screw 26 on the bent piece 4*c* of the throttle lever 4 in the fully closed position and turning the idle adjustment screw 26, the rotary throttle. valve 3 can be positioned at any desired angular position against the spring force of the coiled compression spring 9 thus adjusting the idle speed of an engine.

The projection of the start lever 21 from the carburetor body 1 is minimal. It generally does not project outward further than the throttle lever 4 and thus does not increase the size or bulkiness of the rotary carburetor that would otherwise hinder packaging of the carburetor to an engine driven apparatus. This is achieved because the short rod 21*a* of the start lever 21 projects toward the carburetor main body 1 from a contoured inward surface of the start lever 21 while an opposite outward surface 48 of the start lever 21 that faces outward from the carburetor body 1 is relatively smooth and planar for substantially frictionless rotational sliding against the cantilevered retention arm 14*a* of the pump cover 14. Moreover, the required thickness of the retention arm 14*a* for structural support is minimal due in-part to it's large width or spanning girth.

As a modification to the present invention, a short rod could be provided on the outward surface 48 of the start lever 21 facing the retention arm 14*a*. However, the retention arm 14*a* would have to be made of a separate member attached to the pump cover 14 and the number of component parts would thus increase because the retention arm 14*a* would otherwise interfere with the short rod when assembling the start lever 21.

As another modification to the present invention, the start lever 21 could be provided with a short rod that projects from both sides of the start lever 21. However, the hole 1*b* of the carburetor main body 1 and the bearing for the other end of the short rod have to be aligned with a high precision for the start lever 21 to be able to turn in a smooth fashion. On the other hand, by supporting the upper surface 48 of the start lever 21 with the retention arm 14*a* via a surface contact and making the retention arm 14*a* large enough to support the start lever 21 over the entire range of the angular movement thereof, it is possible to allow the start lever 21 to be turned over the entire angular range in a smooth fashion without requiring any centering with high precision.

While the forms of the invention herein disclosed constitute presently preferred embodiments, many others are possible. It is not intended herein to mention all the possible equivalent forms, modifications or ramifications of the invention. It is understood that terms used herein are merely descriptive, rather than limiting, and that various changes may be made without departing from the spirit or scope of the invention as defined by the following claims.

We claim:

1. An engine start device for a carburetor having a rotary throttle valve oriented in a carburetor body for rotation about a rotary axis causing opening and closing of a fuel-and-air mixing passage in the body and for axial movement varying the amount of liquid fuel flowing into the mixing passage in dependence upon the rotational and axial movement of a throttle lever of the rotary throttle valve located externally from the carburetor body and projecting radially outward with respect to the rotary axis, the engine start device comprising:

an abutment fixed to and projecting axially from the throttle lever and spanning radially with respect to the rotary axis;

a start lever carried by the carburetor body and journaled for rotation about an axis disposed parallel to and spaced from the rotary axis, and engageable with the abutment to rotate the throttle lever; and a releasable camming interface coupler for moving the throttle lever axially when the throttle lever is rotated by the start lever.

2. The engine start device set forth in claim 1 further comprising:

the start lever having an outer surface and a rod disposed concentrically to the axis of the start lever and projecting into a hole of the carburetor body;

a retaining arm engaged to the carburetor body and being in sliding contact with the outer surface for limiting axial movement of the start lever; and wherein rotation of the start lever by an operator rotates the throttle lever in a valve opening direction and simultaneously moves the start lever axially in dependence upon the rotational movement of the start lever.

3. The engine start device set forth in claim 1 further comprising the start lever having a rest position wherein the start lever is not in contact with the throttle valve and the camming interface coupler is released: and a camming state wherein the start lever is in contact with the throttle lever and the camming interface coupler is engaged.

4. The engine start device set forth in claim 1 further comprising the camming interface coupler having a cam carried by the start lever and a cam engagement portion carried by the throttle lever for interaction with the cam.

5. The engine start device set forth in claim 4 further comprising a positioning groove defined by the cam and adapted to receive the cam engagement portion thus positively identifying for the operator a prescribed angular position of the start lever.

6. The engine start device set forth in claim 4 wherein the cam has a plurality of cam surfaces that change height in a step-wise fashion along the rotational direction of the start lever.

7. The engine start device set forth in claim 1 further comprising a positional adjustment screw threaded to the start lever for contacting the abutment and adjusting synchronized movement of the throttle lever with respect to rotational movement of the start lever.

8. The engine start device set forth in claim 4 further comprising a positional adjustment screw threaded to the start lever for contacting the abutment and adjusting synchronized movement of the throttle lever with respect to rotational movement of the start lever.

9. The engine start device set forth in claim 2 wherein the rod projects only from an inner surface of the start lever that faces the carburetor body and not from the outer surface and wherein the outer surface is in rotational sliding contact with the retaining arm.

10. The engine start device set forth in claim 9 further comprising a fuel pump cover removably engaged to the carburetor body and unitarily formed as one piece to the retaining arm.

11. The engine start device set forth in claim 9 wherein the retaining arm is cantilevered over the start lever.

12. The engine start device set forth in claim 2 further comprising an idle adjustment screw threaded to the retaining arm for adjustable abutment by the throttle lever to limit angular movement thereof so as to allow adjustment of an idle position of the throttle lever.

13. The engine start device set forth in claim 8 further comprising:

a retaining arm engaged to the carburetor body and being in sliding rotational contact with the start lever for limiting axial movement of the start lever; and an idle adjustment screw threaded to the retaining arm for adjustable abutment by the throttle lever to limit angular movement thereof thus allowing adjustment of an idle position of the throttle lever.

14. The engine start device set forth in claim 3 further comprising the throttle lever having a manual release lever extending radially outward to facilitate manual release of the start lever out of the camming state.

15. A carburetor for a combustion engine comprising:

a carburetor body;

a fuel-and-air mixing passage extending through the body;

a cylindrical cavity in the body extending transversely across the fuel-and-air mixing passage;

a rotary throttle valve having;

a rotary axis aligned concentrically to the cylindrical cavity, a cylindrical portion seated in the cavity and having a through-bore adjustably generally aligned to the fuel-and-air mixing passage, a throttle lever disposed outside of the body for effecting rotation of the cylindrical portion of the throttle valve thereby adjusting alignment of the through-bore to the fuel-and-air mixing passage for controlling flow of a fuel-and-air mixture, a needle engaged to the cylinder portion, disposed concentrically to the rotary axis and projecting into the through-bore, a fuel feed tube engaged to the body, disposed concentrically to the rotary axis and projecting into the through-bore for axial receipt of the needle, the fuel feed tube having a cylindrical wall carrying an orifice for flowing liquid fuel into the through-bore, and a disengageable cam mechanism oriented between an end surface of the cylindrical portion and the body for axially moving the cylindrical portion as the throttle valve rotates about the rotary axis; and an engine start device for intermittent control of the throttle valve to start a cold combustion engine, the engine start device having a retaining arm projecting from the body, a start lever having an inward surface facing the body and an outward surface in sliding contact with the retaining arm, a rod projecting from the inward surface and into a hole of the body for rotation of the start lever about an axis disposed parallel to the rotary axis, and a cam interface coupler carried between the throttle lever and the start lever and adapted to disengage the camming mechanism.

16. The carburetor set forth in claim 15 wherein the start lever is in a rest position and the cam interface coupler is released when the camming mechanism is engaged.

17. The carburetor set forth in claim 16 further comprising the cam interface coupler having a rib carried by the throttle lever and projecting toward the carburetor body and a sloped cam surface carried by the start lever, facing away from the body and contacting the rib when the cam interface coupler is engaged.

18. The carburetor set forth in claim 17 wherein the rib is arcuate and has a constant radius with respect to the rotary axis and lies in an imaginary plane perpendicular to the rotary axis.

19. The carburetor set forth in claim 18 further comprising at least one groove defined by the cam surface and contoured to receive the arcuate rib when the cam interface coupler is engaged.

20. The carburetor set forth in claim 15 further comprising:

the cylindrical portion of the rotary throttle valve carrying an opposite annular end surface; and the rotary throttle valve having a coiled spring compressed axially between an annular shoulder of the body and the opposite annular end surface for biasing engagement of the camming mechanism and rotation of the rotary throttle valve toward a closed position.

21. The carburetor set forth in claim 20 further comprising the engine start device having a coiled spring disposed concentrically about the axis and having opposite ends engaged between the start lever and the body for biasing the start lever toward a rest position.

22. The carburetor set forth in claim 19 further comprising the engine start device having a coiled spring disposed concentrically about the axis and having opposite ends engaged between the start lever and the body for biasing the start lever toward a rest position wherein operator actuation of the throttle lever in an opening direction causes the rib of the throttle lever to rotate beyond the groove of the cam surface of the start lever causing the cam interface coupler to disengage and the start lever to automatically rotate back to the rest position.

* * * * *

UNITED STATES PATENT AND TRADEMARK OFFICE

CERTIFICATE OF CORRECTION

PATENT NO. : 7,261,280 B2
APPLICATION NO. : 11/333706
DATED : August 28, 2007
INVENTOR(S) : Jun Takano et al.

It is certified that error appears in the above-identified patent and that said Letters Patent is hereby corrected as shown below:

Column 10
Line 32, after "released" delete the colon (:) and insert a comma (,).

Column 11
Line 27, after "having" delete the semicolon (;).

Signed and Sealed this

Eighth Day of January, 2008

JON W. DUDAS
*Director of the United States Patent and Trademark Office*